United States Patent [19]

Foster et al.

[11] Patent Number: 4,883,258

[45] Date of Patent: Nov. 28, 1989

[54] PLASMA FURNACE

[76] Inventors: Atwood P. Foster, 1220 NE. 17th, Portland, Oreg. 97232; Allan L. Berg, 6504 SE. Reedway, Portland, Oreg. 97206

[21] Appl. No.: 244,316

[22] Filed: Sep. 15, 1988

[51] Int. Cl.[4] ..... F27B 15/00

[52] U.S. Cl. ..... 266/148; 373/22; 75/10.19

[58] Field of Search ..... 266/148; 373/22; 75/10.19, 83

[56] References Cited

U.S. PATENT DOCUMENTS

| | | | |
|---|---|---|---|
| 4,469,508 | 9/1984 | Amouroux et al. | 75/10.19 |
| 4,519,835 | 5/1985 | Gauvin et al. | 75/10.19 |
| 4,571,259 | 2/1986 | Fey et al. | 75/10.19 |
| 4,655,437 | 4/1987 | Fritz et al. | 266/197 |
| 4,685,963 | 8/1987 | Saville | 75/10.19 |

*Primary Examiner*—Melvyn J. Andrews
*Attorney, Agent, or Firm*—Henderson & Sturm

[57] ABSTRACT

A plasma furnace including an upper chamber having three electrodes radially spaced from an ore feed tube. The ore is gasified by a plasma arc in a central crucible and allowed to condense in the space between the central crucible and an outer crucible. The outer crucible forms the boundary between the upper chamber and a lower chamber. The lower chamber is filled with molten copper which acts as a filter. Since there is no agitation in the lower chamber, molten ore entering from the upper chamber separates between a fraction containing heavy metals which is drained from a sump, and a fraction containing lighter materials which is decanted through an overflow tube.

6 Claims, 2 Drawing Sheets

PLASMA FURNACE

TECHNICAL FIELD

This invention relates to plasma furnaces, and more particularly to plasma furnaces for metallurgical applications and processes for removing precious metals from ore.

BACKGROUND ART

Plasma technology has been applied to metallurgical processes where the plasma is a gaseous mixture of dissociated molecules, atoms, ions and electrons at very high temperatures. Various devices have been developed to produce plasmas by means of electric arcs, including non-jet types where plasmas are generated intermediate three electrodes connected to a 3-phase alternating current circuit with a pilot arc for starting.

Heretofore, plasma technology has not provided an apparatus and process for efficiently removing precious metals from ore.

Those concerned with these and other problems recognize the need for an improved plasma furnace useful in separating precious metals from ore.

DISCLOSURE OF THE INVENTION

The present invention provides a plasma furnace including an upper chamber having three electrodes radially spaced from an ore feed tube. The ore is gasified by a plasma arc in a central crucible and allowed to condense in the space between the central crucible and an outer crucible. The outer crucible forms the boundary between the upper chamber and a lower chamber. The lower chamber is filled with molten copper which acts as a filter. Since there is no agitation in the lower chamber, molten ore entering from the upper chamber separates between a fraction containing heavy metals which is drained from a sump, and a fraction containing lighter materials which is decanted through an overflow tube.

An object of the present invention is the provision of an improved plasma furnace.

Another object is to provide a plasma furnace that is simple and compact.

A further object of the invention is the provision of a plasma furnace adapted for removing precious metals from ore.

Still another object is to provide a plasma furnace that is durable and easy to maintain.

A still further object of the present invention is the provision of a plasma furnace that is inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings wherein.

BEST MODE FOR CARRYING OUT THE INVENTION

The following example is illustrative of the best mode for carrying out the invention. They are obviously not to be construed as limitative of the invention since various other embodiments can readily be evolved in view of the teachings provided herein.

Figure 1:
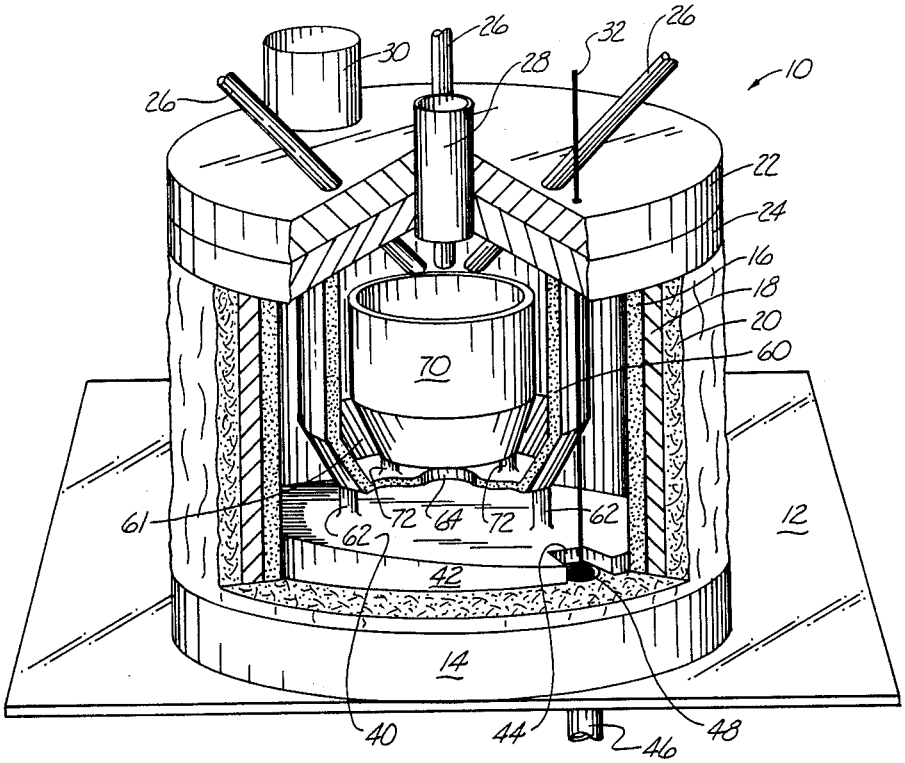
FIG. 1 is a perspective view of the plasma furnace of the present invention with portions cut away to illustrate the relationship of the internal components.
Figure 2:
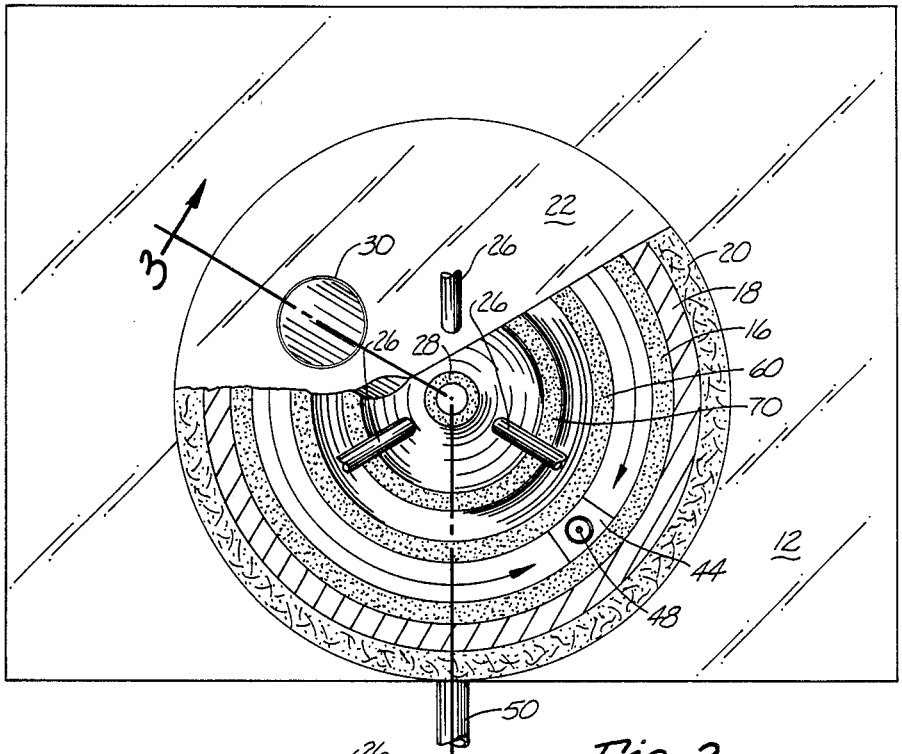
FIG. 2 is a top plan sectional view of the plasma furnace.
Figure 3:
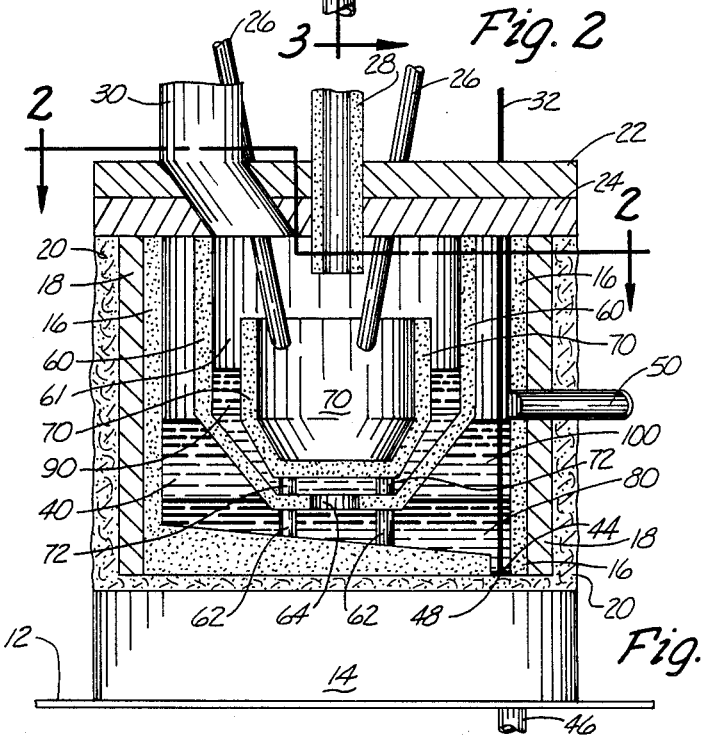
FIG. 3 is a side elevation sectional view of the plasma furnace illustrating the relative levels of the molten materials in the furnace.

Referring now to the drawings, wherein like reference numerals designate identical or corresponding parts throughout the several views, FIG. 1 shows the plasma furnace (10) of the present invention supported on a steel base plate (12). A spacer support (14) rests on the base plate (12). The furnace includes an outer shell or vessel (16) surrounded by a ring (18) of heat-resistant material and a layer of fiber insulation (20). A pair of top plates (22 and 24) are supported by the top of the outer shell (16). The top plates (22 and 24) have openings that sealingly receive three carbon electrodes (26), a feed tube (28), a vent 30 that is in communication with a scrubber (not shown), and a valve operator (32).

The outer shell (16) forms a cavity having a lower chamber (40) which includes a downwardly sloping circular floor (42) that terminates at a sump (44). The sump (44) includes an opening that communicates with a drain tube (46). An inconel plug or valve (48) is received in the opening and is controlled by the valve operator (32). An overflow tube (50) extends from an opening in the sidewall of the outer shell (16).

An outer crucible (60) is supported in the lower chamber (40) by legs (62). The outer crucible (60) extends upwardly to sealingly engage top plate (24) to define an upper chamber (61). The outer crucible (60) includes a central discharge hole (64) that provides for fluid communication between the lower chamber (40) and the upper chamber (61). A central crucible (70) is supported within the outer crucible (60) by legs (72).

The furnace (10) is a simple compact piece of equipment designed to remove the precious metals from ore and to provide valuable by-products.

EXAMPLE 1

8 mesh ore together with twenty weight percent powdered carbon and a small stream of argon plasma gas is fed into the top of the furance (10) through a six inch carbon feed tube (28) with a three inch bore. The ore and the gas fall by gravity into the plasma head, which consists of the area intermediate the three two inch carbon electrodes (26) coming together at angles of 120 degrees from each other. These electrodes (26) carry approximately 80 volt, three phase alternating electric power with a variable current of from 500 to 1,000 amps. This will maintain approximately 30,000° F. (16,500° C.). The heat of this plasma head gasifies the ore and the carbon. The ore contains a large percentage of oxygen. At the temperatures obtained, the carbon and the oxygen unite to form carbon-dioxide, which rises in the vent (30) and is disposed of. The gasified ore rises over the sides of the central crucible (70) and returns to a liquid. It then drops down between the central crucible (70) and the outer crucible (60) as a very hot fluid material. The bottom of the furnace (10) is filled with molten copper (80) which serves as a filter or getter. The molten ore (90) is forced down by gravity through discharge hole (64) in the bottom of the outer crucible (60) into the lower chamber (40) which is filled with molten copper (80).

Lower chamber (40) has a minimum of agitation, allowing the heavy metals to settle and the lighter materials (100) to float or rise to the overflow tube (50). There should be about 1,000 lbs. of obsidian or black marble pouring from the overflow tube (50) per ton of ore fed into the furnace (10). This material (chiefly silicon) can be molded into any number of useful objects or it can be fritzed into a coarse powder for ease of handling. It is a valuable by-product. Heavy metals will gather in the sump (44) and can be drained off at will through the carbon drain tube (46). An INCONEL plug (48) serves as a valve to hold this accumulation of metals. Also, many other metals including gold and silver will alloy with the copper (80) and are drained off regularly for processing.

This plasma furnace process will remove practically all of the metals from the ore, reducing them to an easily refinable concentrate.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

We claim:

1. A plasma furnace for removing precious metals from ore, said plasma furnace comprising:

a vessel having an upper chamber and a lower chamber in fluid communication therewith;

said upper chamber including:

a feed tube attached to said vessel and disposed to extend from exterior said vessel into said upper chamber for feeding ore, carbon and a plasma gas into said upper chamber;

three electrodes attached to said vessel and disposed to extend into said upper chamber at angles of about 120 degrees from each other, said electrodes having ends terminating radially outward from said feed tube, said electrodes being operably connected to a three phase alternating electric power source for producing a plasma arc;

a vent attached to said vessel, said vent providing fluid communication between said upper chamber and the exterior of said vessel;

a central crucible attached to said vessel and supported within said upper chamber below said feed tube such that the ends of said electrodes are disposed within said central crucible; and an outer crucible attached to said vessel and disposed to surround said central crucible in spaced relationship thereto, said outer crucible defining the boundary between said upper chamber and said lower chamber, said outer crucible including a central discharge hole that provides fluid communication between said upper chamber and said lower chamber;

said lower chamber including:

a sloping floor inclined dowardly to a sump;

a drain tube attached to said vessel, said drain tube providing fluid communication between said sump and the exterior of said vessel;

a valve disposed to selectively control the flow of fluid from said sump to said drain tube; and an overflow tube attached to said vessel above the central discharge hole in said outer crucible, said overflow tube providing fluid communication between said lower chamber and the exterior of said vessel.

2. The plasma furnace of claim 1 wherein said feed tube is formed of carbon.

3. The plasma furnace of claim 1 wherein said electrodes are formed of carbon.

4. The plasma furnace of claim 1 wherein said drain tube is formed of carbon.

5. The plasma furnace of claim 1 wherein said overflow tube is formed of carbon.

6. The plasma furnace of claim 1 wherein said valve is a metal plug.

* * * * *